US007631940B1

(12) United States Patent
Jager

(10) Patent No.: US 7,631,940 B1
(45) Date of Patent: Dec. 15, 2009

(54) LOUNGE CHAIR WITH ADJUSTABLE LEGS

(76) Inventor: Barbara K. Jager, 2234 Mc Keown Rd., Hastings, MI (US) 49058

( * ) Notice: Subject to any disclaimer, the term of this patent is extended or adjusted under 35 U.S.C. 154(b) by 0 days.

(21) Appl. No.: 12/370,231

(22) Filed: Feb. 12, 2009

(51) Int. Cl.
*A47C 3/40* (2006.01)

(52) U.S. Cl. ..... 297/344.18; 297/377; 248/188.5

(58) Field of Classification Search ..... 297/344.18, 297/354.13, 377; 248/188.2, 188.4, 188.5
See application file for complete search history.

(56) References Cited

U.S. PATENT DOCUMENTS

| | | | | | |
|---|---|---|---|---|---|
| 36,441 | A * | 9/1862 | Skinner | 297/377 |
| 2,917,104 | A * | 12/1959 | Cottle | 297/423.38 |
| 4,126,355 | A * | 11/1978 | Rosenheck | 297/284.3 |
| 5,246,265 | A * | 9/1993 | Nagan et al. | 297/54 |
| 5,494,333 | A | 2/1996 | Wilson | |
| 5,536,063 | A * | 7/1996 | Cable | 297/16.2 |
| 5,556,166 | A * | 9/1996 | Synnestvedt | 297/377 |
| 6,056,353 | A | 5/2000 | Meara | |
| 6,095,607 | A | 8/2000 | Wenzel | |
| 6,702,384 | B1 * | 3/2004 | Brown | 297/344.18 |
| 6,921,135 | B2 * | 7/2005 | Ellis et al. | 297/344.18 |
| 2003/0102700 | A1 * | 6/2003 | Lin | 297/183.9 |

* cited by examiner

*Primary Examiner*—Peter R. Brown
(74) *Attorney, Agent, or Firm*—Crossley Patent Law; Mark A. Crossley

(57) ABSTRACT

A lounge chair having a frame with a seat portion and a 180-degree pivotally adjustable backrest portion and a plurality of telescopic, height-adjustable legs with a twist-lock compression fitting on each leg. A reinforced support bar fits over each end of a strap across the seat portion and across the backrest portion to provide secure attachment to the frame.

8 Claims, 5 Drawing Sheets

LOUNGE CHAIR WITH ADJUSTABLE LEGS

BACKGROUND OF THE INVENTION

Various types of chairs are known in the prior art. Prior art patents disclose a folding adjustable chair to accommodate joint dysfunction; an adjustable leg chair; and a hillside chair with adjustable legs and leveling feet. However, what is needed is a lounge chair with a 180-degree pivotable backrest portion, a plurality of telescopic, height-adjustable legs, each leg having a twist-lock compression fitting to lock the leg into a desired vertical position.

FIELD OF THE INVENTION

The present invention relates to chairs, and more particularly, to a lounge chair with telescopic, height-adjustable legs, with a twist-locking feature.

SUMMARY OF THE INVENTION

The present lounge chair is designed to enable elderly or physically disabled individuals to relax outdoors easily and independently by providing telescopic, height-adjustable legs with a twist-lock compression fitting to lock the legs into a desired vertical position. The chair has a foot which may be trapezoidal-shaped to prevent slippage and movement of the chair during the process of vertically adjusting the legs and locking the legs into a desired vertical position. The present chair enhances the quality of life for an elderly or physically disable individual by eliminating embarrassment, decreasing pain, preventing injury, and adding complications associated with existing injuries. The present lounge chair provides outdoor seating for individuals who have hip or knee replacements as well as arthritic individuals. The backrest portion of the chair pivots 180-degrees, which allows the chair to be adjusted in a range of positions from completely flat either against the frame or against the seat portion to a number of sitting positions, thereby facilitating portability as well as comfort. The chair is armless thereby allowing accessibility by individuals from various directions while in the process of sitting on the chair.

Thus has been broadly outlined the more important features of the present chair and method so that the detailed description thereof that follows may be better understood and in order that the present contribution to the art may be better appreciated.

Numerous objects, features and advantages of the present chair will be readily apparent to those of ordinary skill in the art upon reading the following detailed description of presently preferred, but nonetheless illustrative, examples of the present chair and method when taken in conjunction with the accompanying drawings. In this respect, before explaining the current examples of the present chair and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the chair and method. It is therefore important that the claims be regarded as including such equivalent constructions insofar as they do not depart from the spirit and scope of the present invention.

Objects of the present chair and method, along with various novel features that characterize the invention are particularly pointed out in the claims forming a part of this disclosure. For better understanding of the chair and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
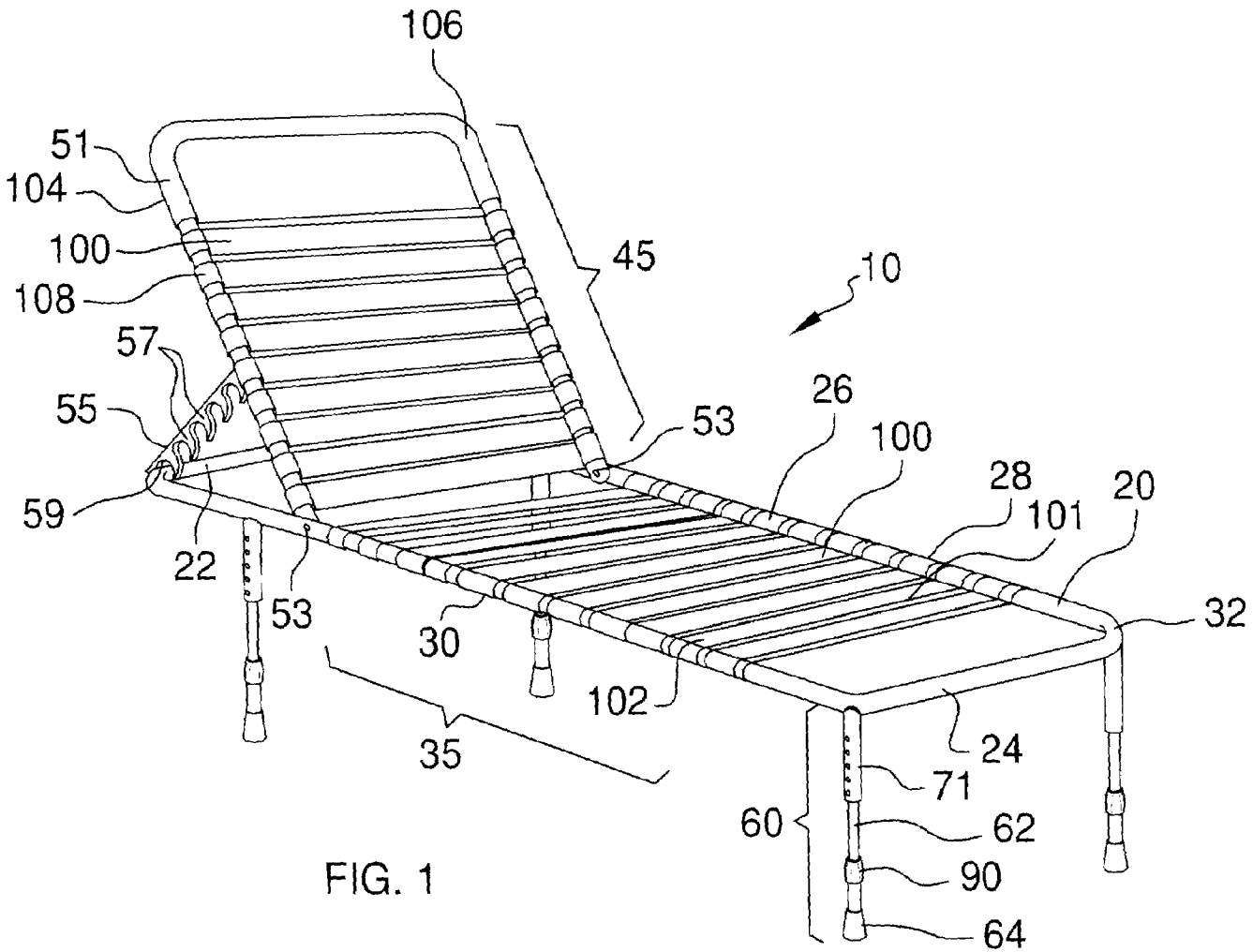
FIG. 1 is an isometric view.
Figure 2:
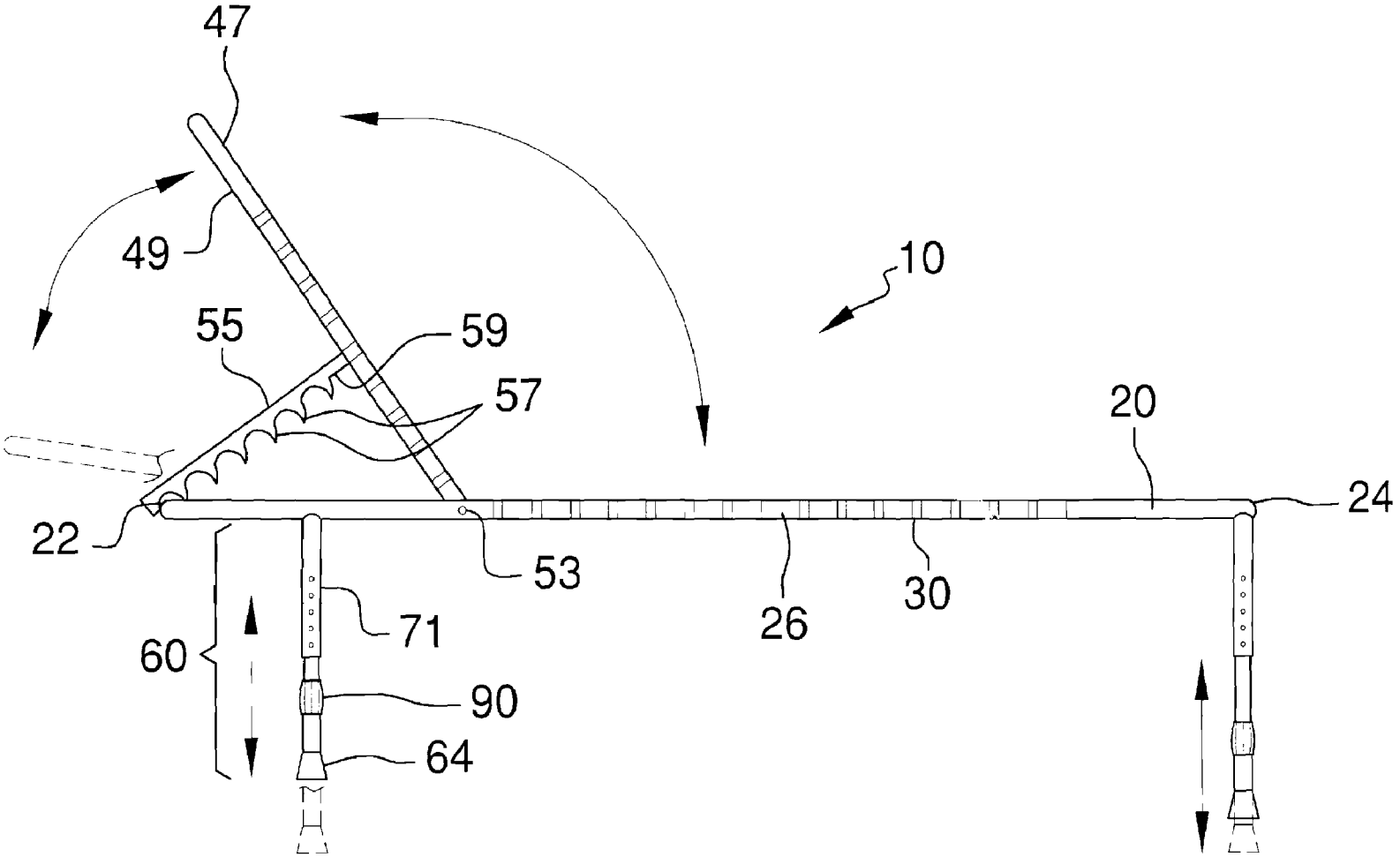
FIG. 2 is a side elevation view.
Figure 3:
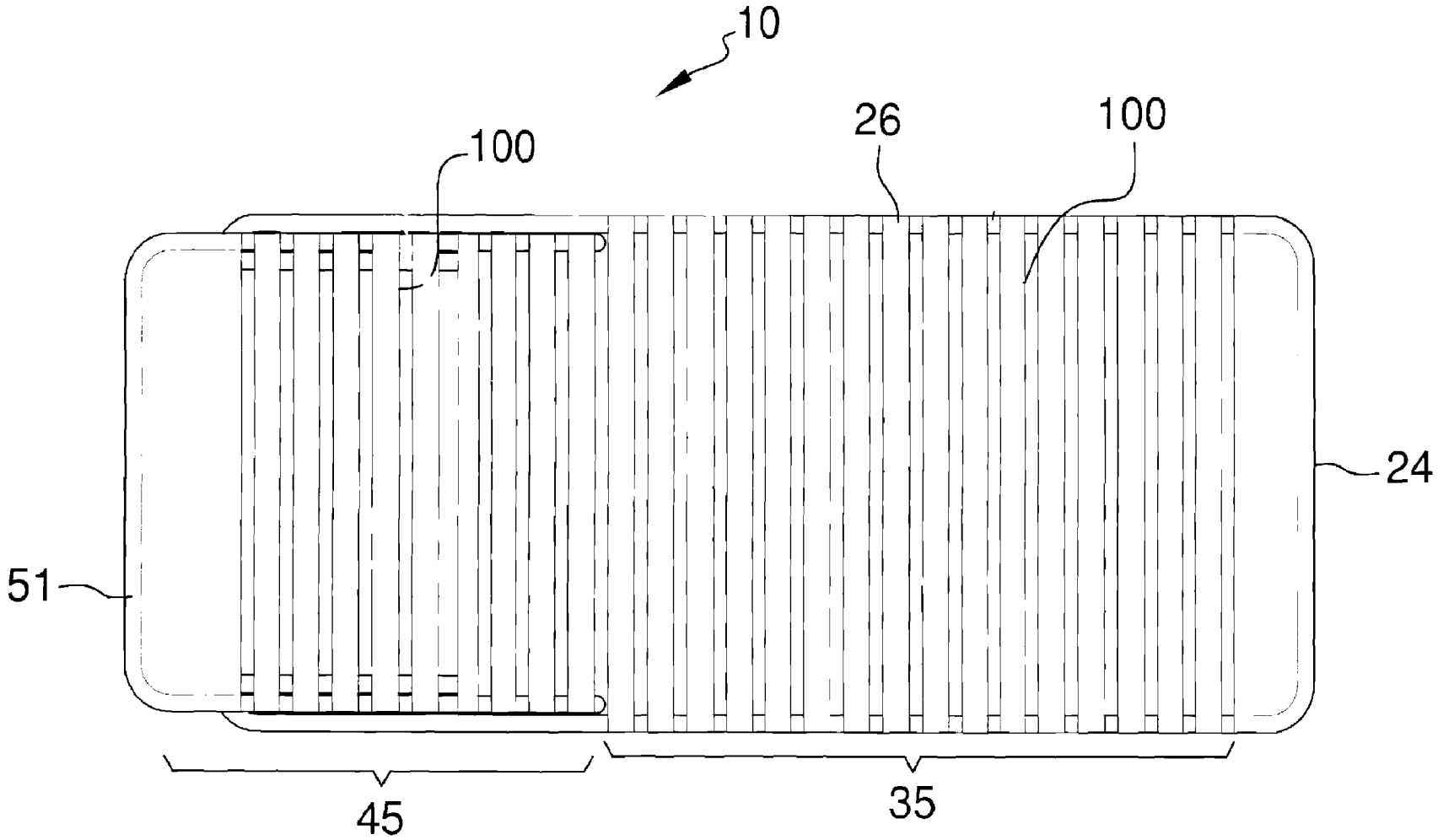
FIG. 3 is a top plan view.
Figure 4:
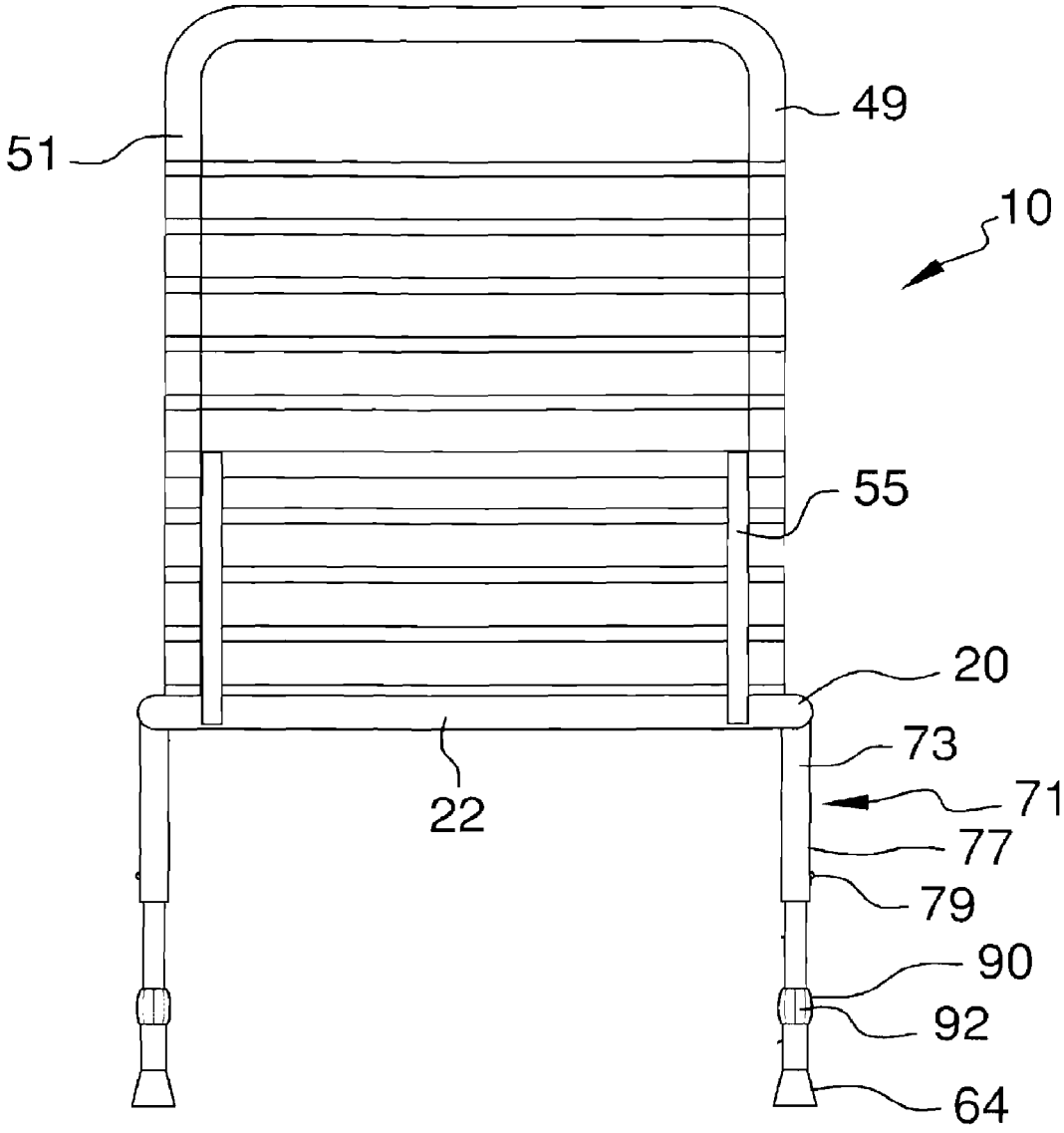
FIG. 4 is a rear elevation view.
Figure 5:
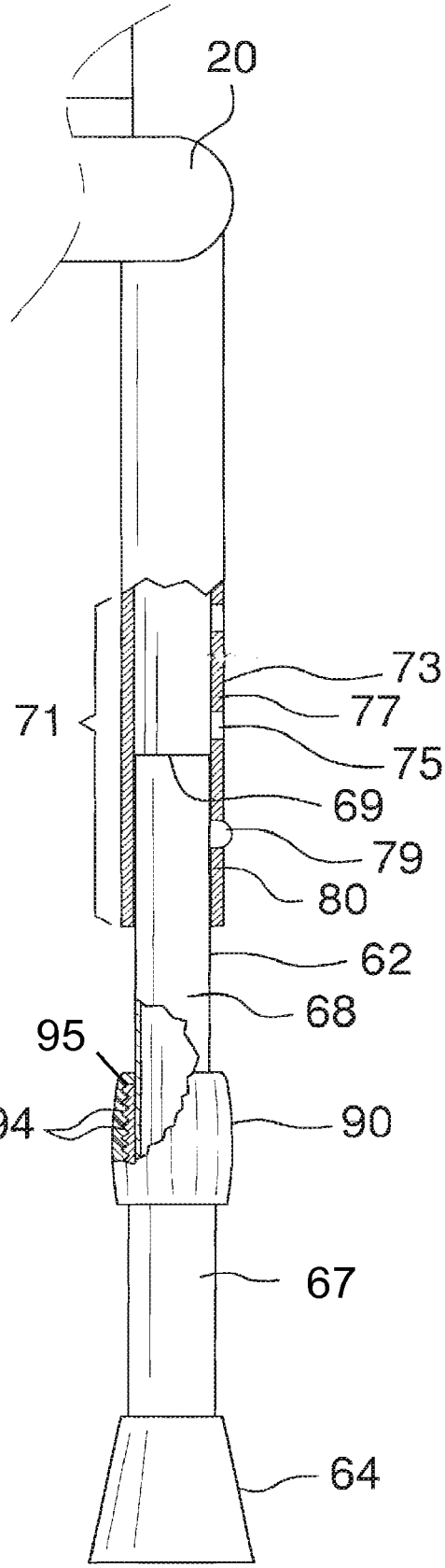
FIG. 5 is a detail view of a vertical adjustment mechanism and a locking mechanism.

With reference now to the drawings, and in particular FIGS. 1 through 5 thereof, example of the instant chair employing the principles and concepts of the present chair and generally designated by the reference number 10 will be described.

Referring to FIGS. 1 through 5 a preferred embodiment of the present lounge chair 10 is illustrated. The present lounge chair 10 includes a hollow parallelepiped frame 20 having a head end 22, a foot end 24, a mid-section 26 between the head end 22 and the foot end 24, spaced side members 28, 30, and four corners 32. The chair 10 further includes a seat portion 35 and a backrest portion 45. The seat portion 35 is suspended between the side members 28, 30 of the frame 20 mid-section 26.

The vertically-adjustable backrest portion 45 has a front side 47 and a back side 49. The backrest portion 45 includes a U-shaped hollow tube 51 pivotally attached at a pivot point 53 on the spaced side members 28, 30 of the frame 20 in a position adjacent to the seat portion 35 and at least partially covering the head end 22 of the frame 20. The backrest portion 45 is pivotable 180 degrees thereby allowing the backrest portion 45 to pivot both backwardly and forwardly to lie flat against the seat portion 35.

An elongated support member 55 pivotally attached to the back side 49 of the backrest portion 45. A plurality of teeth 57 is continuously disposed along a lower edge 59 of the support member 55. The teeth 57 selectively engage the head end 22 of the frame 20.

A pair of telescopic legs 60 extends downwardly from the corners 32 on the foot end 24 of the frame 20. An identical pair of telescopic legs 60 extends downwardly from the frame 20 near each pivot point 53. Each of the legs 60 has a body 62 and a foot 64. The body 62 has an upper end 69 and a lower end 68.

A vertical adjustment mechanism 71 is disposed on each of the legs 60. The vertical adjustment mechanism 71 includes a hollow sleeve 73 connected to and extending downwardly from the frame 20. The sleeve 73 has a plurality of vertically aligned apertures 75 along an outer edge 77 of the sleeve 73. The vertical adjustment mechanism 71 also includes a retractable protrusion 79 disposed on an outside edge 80 of the body 62 near the upper end of the body 62. The protrusion 79 selectively engages the apertures 75 thus allowing each leg 60 to be adjusted to a desired height.

A locking mechanism 90 is disposed on the body 62 lower end 68 between the protrusion 79 and the foot 64. The locking mechanism 90 includes a twist look compression fitting 92 having a threaded section 94 wherein the threaded section 94 is engaged with a threaded upper end 95 of a lower tube 67 to tighten and lock against the lower end 68 of the body 62. The locking mechanism 90 further locks the legs 60 of the present lounge chair 10 into a desired height. The foot 64 may have a trapezoidal shape to provide more resistance to movement and sliding of the lounge chair 10 than if the foot 64 had less contact area with the surface upon which the chair 10 is placed. The trapezoidal-shaped foot 64 thereby permits a user to adjust the vertical height of the legs 60 with the vertical adjustment mechanism 71 and to lock the legs 60 into a desired vertical height with the locking mechanism 90 more easily because the chair 10 does not slide or move easily during the adjustment process. The legs 60 are vertically adjustable to about 17 inches.

The seat portion includes a plurality of semi-flexible straps 100. The straps 100 are disposed in parallel position to each other across the mid-section 26. Each strap 100 has a first end 101 and a second end 102 secured to the frame 20 between the side members 28, 30.

A plurality of the semi-flexible straps 100 are also horizontally disposed across the backrest portion 45. The straps 100 are disposed in parallel position to each other. Each strap 100 has a first end 101 secured to a left portion 104 of the tube 51 and a second end 201 secured to a right portion 106 of the tube 51. A reinforced support bar 108 fits over the first end 101 and second end 102 of each strap 100 and around the frame 20 to strengthen the attachment of each strap 100 to the frame 20. The straps 100 may be formed of vinyl.

The frame 20, tube 51, and legs may be formed of aluminum. The foot 64 may be formed of non-slip rubber.

With respect to the above description then, it is to be realized that the optimum dimensional relationships for the parts of the present chair to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A lounge chair comprising:

a hollow parallelepiped frame having a head end, a foot end, a mid-section between the head end and the foot end, spaced side members and four corners;

a seat portion suspended between the side members of the frame mid-section;

a vertically-adjustable backrest portion having a front side and a back side, the backrest portion comprising:

a U-shaped hollow tube pivotally attached at a pivot point between the side members in a position adjacent to the seat portion and at least partially covering the head end of the frame an elongated support member pivotally attached to the back side of the backrest portion;

a plurality of teeth continuously disposed along a lower edge of the support member, the teeth selectively engaging the head end of the frame;

a pair of telescopic legs extending downwardly from the corners on the foot end of the frame; and a pair of telescopic legs extending downwardly from the frame near the pivot point, the legs having a body and a foot, the body having an upper end and a lower end;

a vertical adjustment mechanism disposed on the upper end of each of the legs, the vertical adjustment mechanism comprising:

a hollow sleeve connected to and extending downwardly from the frame, the body slidable within the hollow sleeve at a body upper end and, in turn, slidable within a lower tube at the body lower end, the sleeve having a plurality of vertically aligned apertures along an outer edge of the sleeve, and a retractable protrusion disposed on an outside edge of the body upper end near the juncture, wherein the protrusion selectively engages the apertures, a locking mechanism disposed on the lower end between the protrusion and the foot, the locking mechanism comprising:

a twist look compression fitting having a threaded section, wherein the threaded section is engaged with a threaded upper end of a lower sleeve whereby the compression fitting tightens and locks against the lower end of the body.

2. The lounge chair of claim 1 wherein the backrest portion pivots 180 degrees.

3. The lounge chair of claim 2 wherein the foot is trapezoidal-shaped.

4. The lounge chair of claim 3 further comprising:

a seat portion comprising a plurality of semi-flexible straps, the straps disposed in parallel position to each other across the frame mid-section, each of the straps having a first end secured to the frame right side and a second end secured to the frame left side, and a plurality of semi-flexible straps horizontally disposed across the backrest portion, the straps in parallel position to each other, the straps having a first end secured a left portion and a right portion of the tube.

5. The lounge chair of claim 4 further comprising a reinforced support bar fitting over the first end and second end of each strap and around the frame wherein the support bar strengthens the attachment of each strap to the frame.

6. The lounge chair of claim 1 wherein the foot is trapezoidal-shaped.

7. The lounge chair of claim 1 further comprising:

a seat portion comprising a plurality of semi-flexible straps, the straps disposed in parallel position to each other across the frame mid-section, each of the straps having a first end secured to the frame right side and a second end secured to the frame left side, and a plurality of semi-flexible straps horizontally disposed across the backrest portion, the straps in parallel position to each other, the straps having a first end secured a left portion and a right portion of the tube.

8. The lounge chair of claim 7 further comprising a reinforced support bar fitting over the first end and second end of each strap and around the frame wherein the support bar strengthens the attachment of each strap to the frame.

* * * * *